US010181680B1

(12) United States Patent
Crowder

(10) Patent No.: US 10,181,680 B1
(45) Date of Patent: Jan. 15, 2019

(54) SECURABLE POWER ADAPTER

(71) Applicant: Robert Crowder, Chicago, IL (US)

(72) Inventor: Robert Crowder, Chicago, IL (US)

( * ) Notice: Subject to any disclaimer, the term of this patent is extended or adjusted under 35 U.S.C. 154(b) by 0 days.

(21) Appl. No.: 15/725,224

(22) Filed: Oct. 4, 2017

(51) Int. Cl.
*H01R 25/00* (2006.01)
*H01R 13/639* (2006.01)
*H01R 13/58* (2006.01)
*H01R 31/06* (2006.01)

(52) U.S. Cl.
CPC ..... *H01R 13/639* (2013.01); *H01R 13/58* (2013.01); *H01R 13/6395* (2013.01); *H01R 31/06* (2013.01)

(58) Field of Classification Search
CPC ..... H01R 35/04; H01R 27/00; H01R 25/006; H01R 23/025; H01R 31/06; H01R 31/02; H02G 3/14
USPC ..... 439/131, 172, 535, 536, 650–652; 174/66, 67
See application file for complete search history.

(56) References Cited

U.S. PATENT DOCUMENTS 1,341,468 A 5/1920 Kenney
1,511,855 A * 10/1924 Wentz ..... H01R 31/02 439/652
1,976,501 A 10/1934 James
2,002,558 A 5/1935 Von Holtz
2,199,560 A * 5/1940 Faller ..... H01R 27/02 439/314
2,436,586 A 2/1948 Mangold
3,161,450 A * 12/1964 Goodenough ..... H01R 13/6215 174/66
3,579,283 A 5/1971 Welburn
3,775,727 A * 11/1973 Wise ..... H01R 31/06 439/105
4,061,409 A 12/1977 Bealmear
4,494,809 A * 1/1985 Soloman ..... H01R 31/06 439/134
4,579,410 A * 4/1986 Soloman ..... H01R 31/06 439/133
5,409,397 A * 4/1995 Karman ..... H01R 13/6335 439/105
5,551,884 A 9/1996 Burkhart, Sr.
6,171,129 B1 1/2001 Phillips
6,315,593 B1 11/2001 Bentley et al.
6,753,755 B2 * 6/2004 Montague ..... H01R 13/4534 337/187
7,077,683 B1 7/2006 Ross
7,798,838 B2 9/2010 Grieff et al.
8,668,516 B2 * 3/2014 Lee ..... H01R 13/6691 439/489
9,147,973 B1 * 9/2015 Madison ..... H01R 13/6395
9,197,018 B2 * 11/2015 Garofalo ..... H01R 13/6395
(Continued)

*Primary Examiner* — Thanh Tam Le
(74) *Attorney, Agent, or Firm* — Law Office of Mark Brown, LLC; Christopher M. DeBacker

(57) ABSTRACT

A power adapter with a cord-fastening, and one or more fastening tabs for semi-permanently securing the power adapter to a wall socket. Female receptacles within the device can be designed to accept standard corded connections widely accepted in use with electronic devices (e.g. mobile phones, tablets, and other personal electronic devices) such as male ends of various USB (Universal Serial Bus) standards or other well-known connector types. Male prongs can be designed to fit into a standard wall outlet, and optionally can be designed to fold into the adapter body when not in use.

3 Claims, 8 Drawing Sheets

(56) References Cited

U.S. PATENT DOCUMENTS

| | | | | |
|---|---|---|---|---|
| 9,825,414 | B2 * | 11/2017 | Armstrong | H01R 31/06 |
| 2013/0337675 | A1 | 12/2013 | Cai et al. | |
| 2014/0213093 | A1 | 7/2014 | Tal et al. | |

* cited by examiner

SECURABLE POWER ADAPTER

BACKGROUND

The present disclosure is generally directed to power adapters for mobile phones and other electronic devices, and more particularly to a power adapter that can be inserted and selectively secured into a standard outlet socket.

With the ubiquitous presence of electronic devices such as mobile phones, tablet computers, and laptop computers, and the current state of battery and charging technology, users of such devices are often in need of solutions for charging the batteries and powering up such devices while they are outside of their home or in a public or shared space. Some public or private accommodations offer the use of wireless charging stations, but these are often only compatible with a small subset of devices.

Offering charging solutions for a larger range of devices typically involves leaving power adapters plugged into a wall outlet in an unsecured manner. Power adapters that are plugged in but not secured may be accidentally removed from the outlet, or may be purposely removed and stolen or broken. The connections and cords may also be removed from the Power Supply Unit (PSU) of unsecured adapters, and stolen or broken. Alternately, adapters may be secured with means that are not specifically designed for such adapters and thus are unwieldy or easily overcome.

U.S. Pat. No. 9,147,973 describes an "enclosure for wall charger" that allows a power adapter to be secured to a wall outlet and a power cord to be secured to the enclosure. The device described is a plastic casing that is molded to go over a PSU. The device described suffers from the drawbacks of only being compatible with specific devices (principally Apple's iPhone) and power adapters due to the shape and size of the enclosure. The device described also suffers from the drawbacks of only allowing for one orientation when inserted into a wall socket due to the presence of only a single fastening tab for securing the enclosure to a wall socket, and requiring additional equipment such as a zip tie in order to secure a power adapter cord.

It would be useful to have a power adapter that can be secured into a wall socket and can optionally secure a power cord, without the drawbacks of existing securing solutions.

SUMMARY

In one example of a securable power adapter according to this invention, the power adapter has an adapter body, one or more female receptacles in one surface of the adapter body, a cord-fastening means on a surface of the adapter body, male prongs extending from another surface of the adapter body, and one or more fastening tabs extending from a surface of the adapter body. The female receptacles can be designed to accept standard corded connections widely accepted in use with electronic devices (e.g. mobile phones, tablets, and other personal electronic devices) such as male ends of various USB (Universal Serial Bus) standards or Apple's Lightning connector. The male prongs can be designed to fit into a standard wall outlet, and optionally can be designed to fold into the adapter body when not in use.

In another example of a securable power adapter according to this invention, the power adapter has an adapter body, a cord connection protruding from a surface of the adapter body, male prongs extending from another surface of the adapter body, and one or more fastening tabs extending from a surface of the adapter body. The male prongs can be designed to fit into a standard wall outlet, and optionally can be designed to fold into the adapter body when not in use.

These as well as other aspects, advantages, and alternatives, will become apparent to those of ordinary skill in the art by reading the following detailed description, with reference where appropriate to the accompanying drawings.

DETAILED DESCRIPTION

Figure 1:
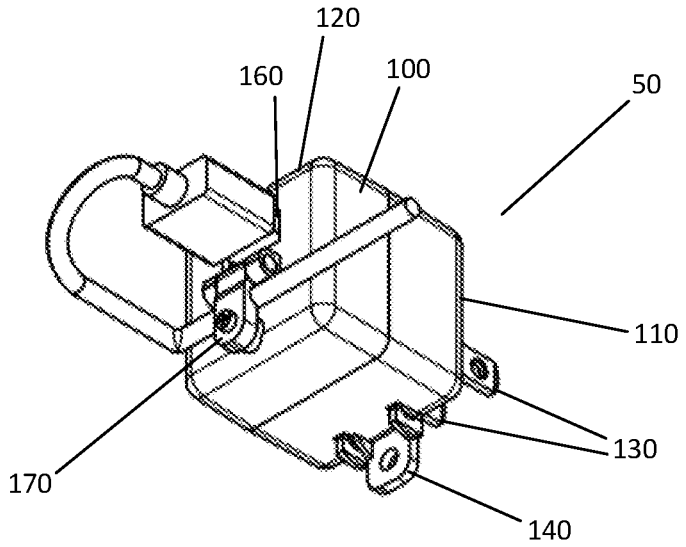
FIG. 1 is an isometric view of an example embodiment showing the surface containing a female receptacle and cord-fastening means.

In the particular embodiment illustrated in FIG. 1, the power adapter 50 includes an adapter body 100, a male end 110, and a female end 120. The adapter body 100 has a rectangular or polygon shape. The adapter body 100 is composed of any suitable, non-conductive material, such as molded plastic or hard rubber, and is fabricated using any suitable process. The adapter body 100 is substantially rigid, and durable enough to provide a protective cover for the internal components.

Figure 2:
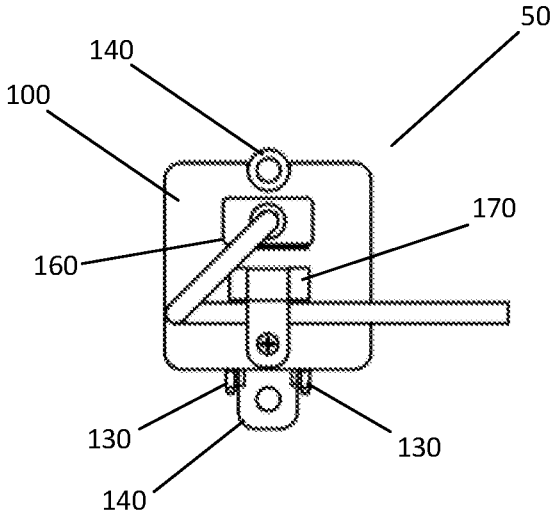
FIG. 2 is a front view of an example embodiment.
Figure 3:
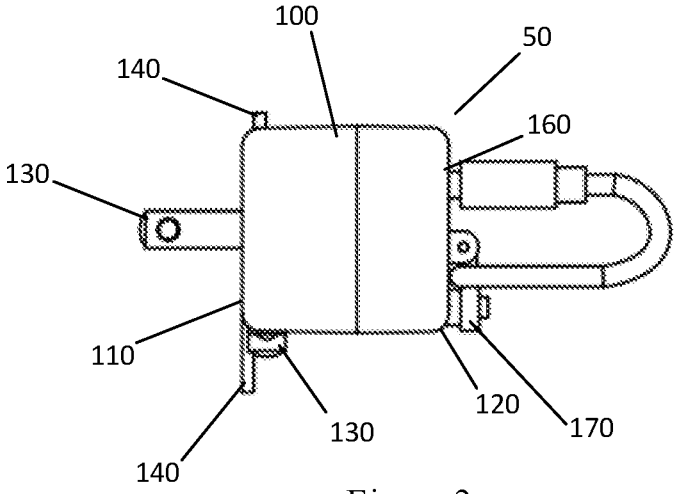
FIG. 3 is a side view of an example embodiment.
Figure 4:
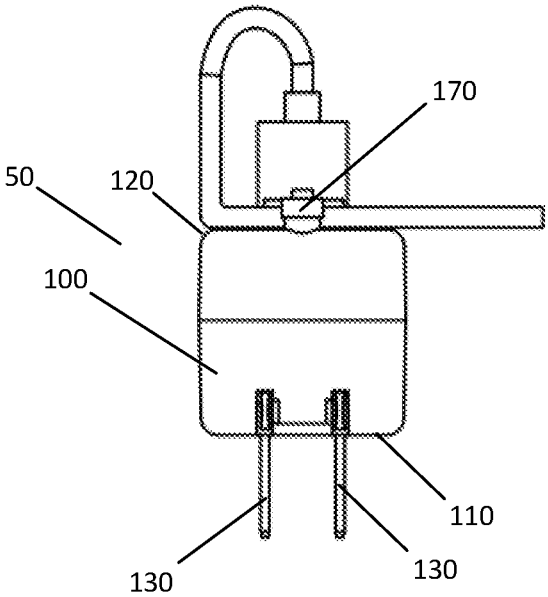
FIG. 4 is a bottom view of an example embodiment.
Figure 5:
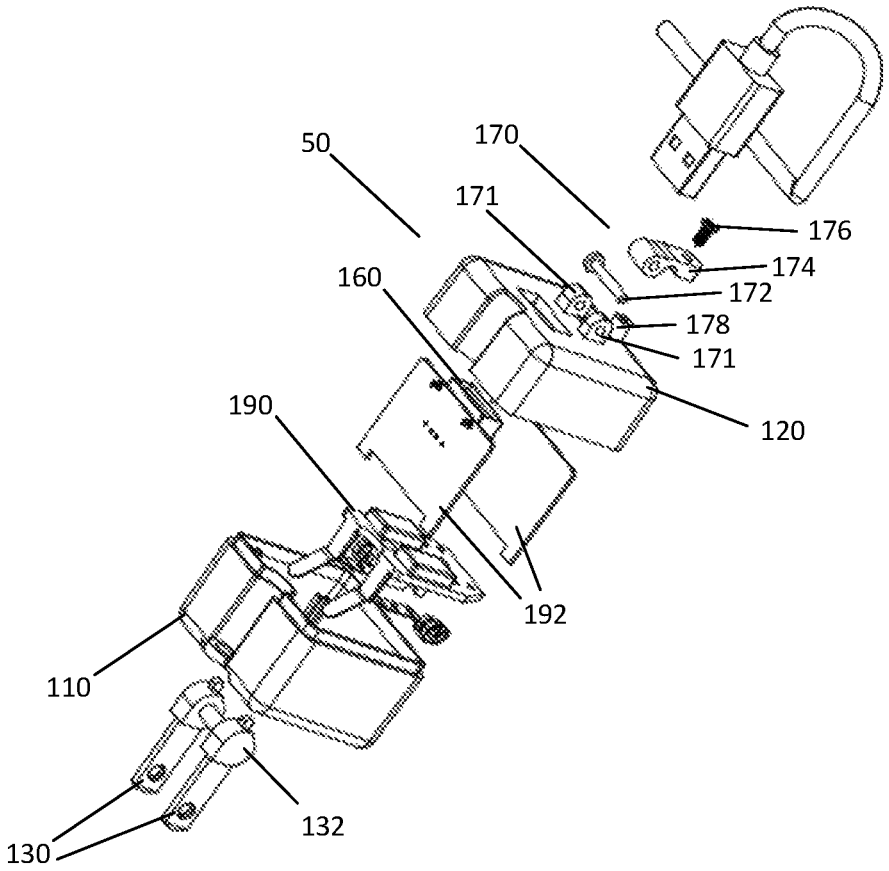
FIG. 5 is an isometric exploded view of the internal structure of an example embodiment showing a USB connection and foldable male prongs.
Figure 6:
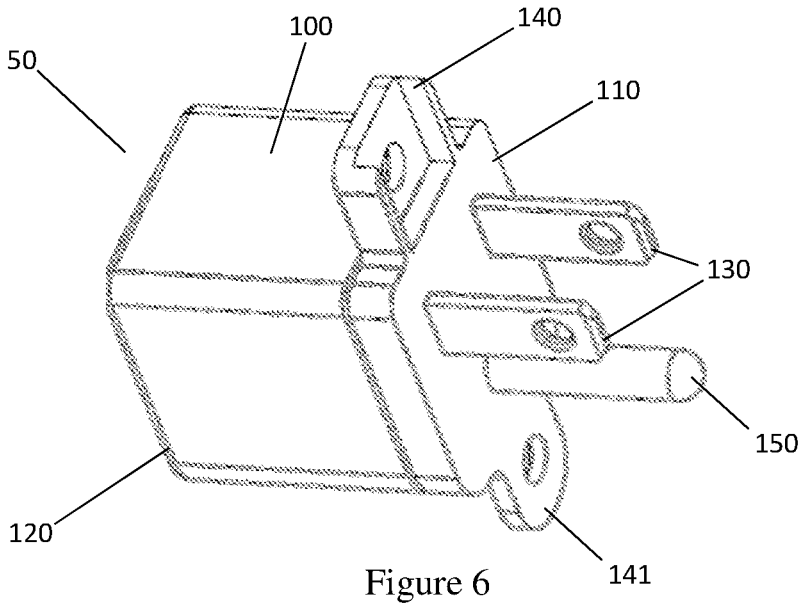
FIG. 6 is an isometric view of an example embodiment showing the surface containing male prongs and fastening tabs.

Male end 110 has two male connector prongs 130 extending from the surface of adapter body 100. The two connector male prongs 130 include a positive male prong and a neutral male prong. Male end 110 also optionally has a ground prong 150, as depicted in FIG. 6, extending from the surface of adapter body 100. The two male connector prongs 130 and the male ground prong 150 are composed of conductive material that is typically used for such components, such as copper, brass, or stainless steel. The two male connector prongs 130 and the ground prong 150 are sized and shaped to be inserted into corresponding receptacles in a standard wall outlet. Male connector prongs 130 may optionally be configured as foldable prongs as depicted in FIG. 5. When configured as foldable prongs, prong rotation mechanism 132 is connected to male connector prongs 130 and allows male connector prongs 130 to rotate or fold into the adapter body 100 when adapter 50 is not in use. FIGS. 1-3 also show male connector prongs 130 in the folded position. Foldable prongs are well-known in the art and are not further described here.

Figure 6A:
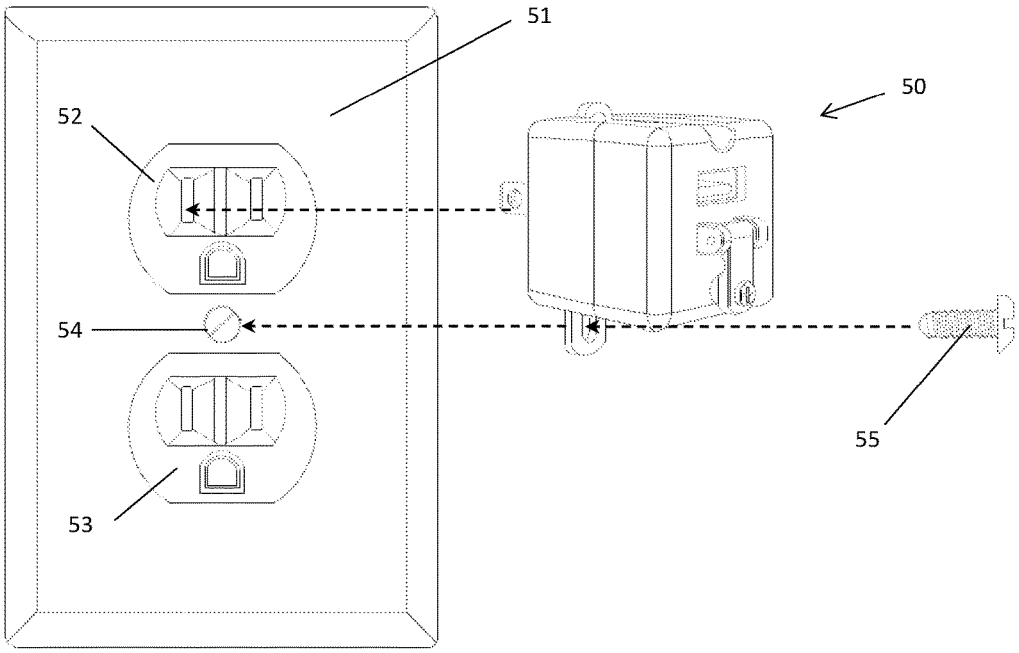
FIG. 6A is an isometric view of an example embodiment showing an embodiment of the present invention being inserted into a top power outlet.
Figure 6B:
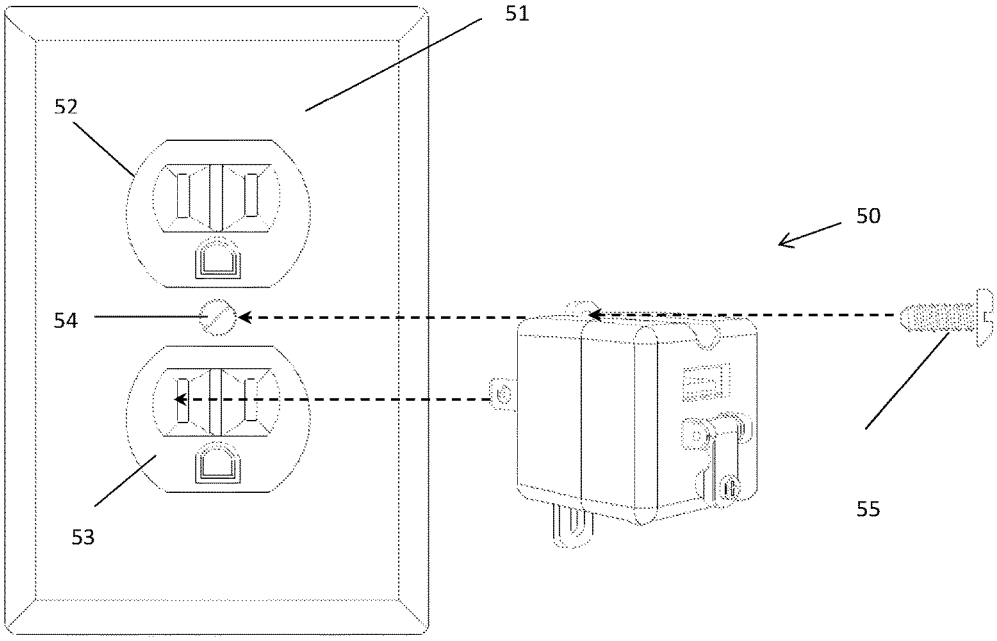
FIG. 6B is an isometric view of an example embodiment showing an embodiment of the present invention being inserted into a bottom power outlet.
Figure 6C:
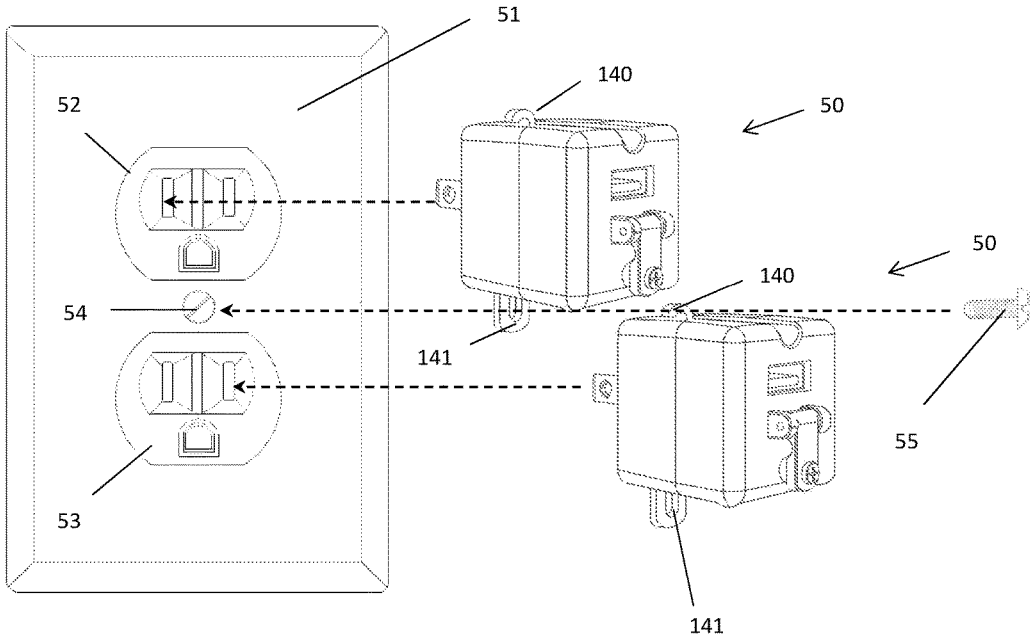
FIG. 6C is an isometric view of two example embodiments of the present invention, one being inserted into a top power outlet and one being inserted into a bottom power outlet.

Male end 110 also has two fastening tabs, a top tab 140, and a bottom tab 141. The two fastening tabs 140, 141 extend from the surface of male end 110 in a plane that is parallel to the orientation of a wall socket to which power adapter 50 is designed to be inserted. Fastening tabs 140, 141 are substantially flat and contain an aperture that is sized and shaped to allow a screw 55 to be inserted through fastening tabs 140, 141 and secured in the faceplate 51 fastening holes 54 of most typical wall outlets, thus securing the entire power adapter 50 to the wall outlet. As depicted in FIG. 6, fastening tabs 140 141 are shaped such that one fastening tab 140 fits into another 141 and allows two adapters to be inserted into and fastened to different sockets on the same wall outlet unit as shown in FIG. 6C. Adapter body 100 has two fastening tabs 140, 141 to accommodate being used in either the top 52 or bottom 53 outlet in a vertically oriented standard wall outlet, as shown in FIGS. 6A and 6B, respectively, or in either the left or right outlet in a horizontally oriented standard wall outlet. Fastening tabs 140, 141 are composed of the same non-conductive material as the adapter body 100 or can alternately be composed of another material that is suitably rigid and durable. Fastening tabs 140 may also be composed of a conductive material and serve as a replacement for a grounding prong. Male end 110 may also have only a single fastening tab 140.

Female end 120 has a female USB receptacle 160. The female USB receptacle 160 is open to and extends into the surface of female end 120. The female USB receptacle 160 is sized and shaped to receive corresponding male USB connections according the USB specification that is well-known in the art. Female USB receptacle 160 may alternately be replaced with another type of female receptacle that is capable of receiving male connections of specified designs for device chargers, such as lightning chargers for Apple iPhones.

Female end 120 also has cord-fastening means 170. As depicted in FIG. 5, cord-fastening means 170 is a latch-style fastener composed of rod 172, lever arm 174, and screw hole 178. Rod 172 is a cylindrical rod composed of plastic, metal, or another suitably rigid material. Rod 172 is secured to adapter body 100 by anchors 171. Anchors 171 protrude from adapter body 100, and contain circular holes of a similar diameter as rod 171. Anchors 171 are composed of similar material to adapter body 100 or another suitably rigid but flexible material. Rod 172 is inserted into anchors 171 and secured by glue, solder, or another suitable adhesive. Rod 172 is inserted through a hole in lever arm 174. Rod 172 allows lever arm 174 to rotate axially about a point near the surface of adapter body 100. Lever arm 174 is composed of similar material to rod 172 or another suitably rigid but flexible material. Lever arm 174 has a hole that allows a screw 176 to be inserted through it and into screw hole 178, in such a manner that lever arm 174 will be secured in place by the inserted screw 176, and any cord that is between lever arm 174 and adapter body 100 will also be secured. Screw hole 178 is a protruding hollow shaft containing threads that allows a standard screw 176 to be inserted and secured. While cord-fastening means 170 has been described as a latch-style fastener, other cord-fastening means are contemplated and compatible with this invention, such as button fasteners, thread fasteners, zip fasteners, rivets, screw fasteners, slide fasteners, clips, groove fasteners, clasp fasteners, or posts to weave/tie/secure the cord to. In alternate fastener designs, there may or may not be a screw, screw hole, hinge, or lever. The securing of the male connection can be applied to the cord, cord's strain relief, or the base of the connection.

FIG. 5 illustrates the internal details of adapter 50, which includes power supply unit 190 and boards 192. Power supply unit 190 is a standard power supply unit that is designed to connect to male connector prongs 130 and USB receptacle 160, providing the required power output to USB receptacle 160 when male connector prongs 130 are connected to an electrical power source such as a standard wall outlet. Power supply unit 190 is well-known in the art and is not described further here. Boards 192 provide mounting support for power supply unit 190, USB receptacle 160, and any other components required for power adapter 50 to function as a power adapter/charger. Boards 192 are well-known in the art and are not described further here.

Figure 7:
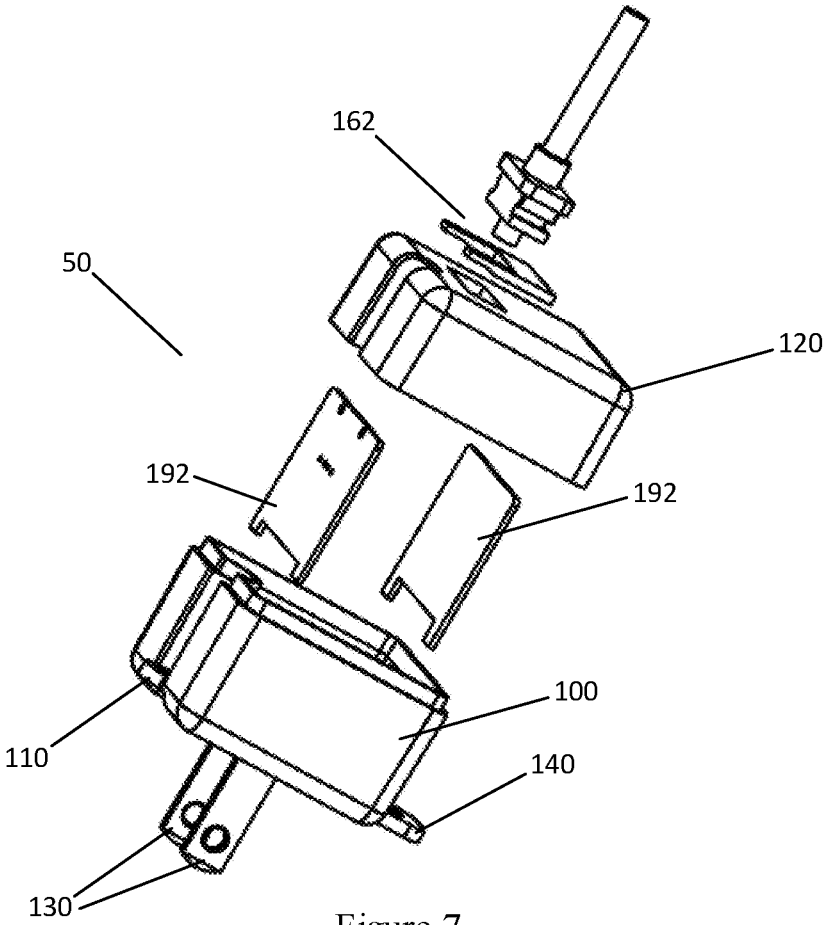
FIG. 7 is an isometric exploded view of the internal structure of an example embodiment showing a fixed cord connection.

FIG. 7 illustrates an alternative configuration where USB receptacle 160 is replaced by fixed cord connection 162. This configuration also lacks cord-fastening means 170 because fixed cord connection 162 is designed to not allow a cord to be removed.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims. Other embodiments may be utilized, and other changes may be made, without departing from the spirit or scope of the subject matter presented herein, for example, female end 120 and corresponding female USB receptacle 160 can be located on a side of adapter body 100 that is adjacent to male end 110, rather than on the side of adapter body 100 that is opposite male end 110, resulting in a perpendicular configuration. Another alternate configuration may include multiple female ends 120 on one power adapter. It will be readily understood that the aspects of the present disclosure, as generally described herein and illustrated in the figures, can be arranged, substituted, combined, separated, and designed in a wide variety of different configurations, all of which are contemplated herein.

What is claimed is:

1. A power adapter comprising:

an adapter body having a first surface and a second surface;

a female USB receptacle in the first surface of the adapter body;

male prongs extending from the second surface of the adapter body;

a first fastening tab extending from the second surface of the adapter body;

a cord-fastening means comprising a lever arm having a first end and a second end, a rod pinning said first end to said first surface of said adapter body, and a locking element configured to releasably lock said second end to said first surface of said adapter body; and wherein said cord-fastening means is associated with the female USB receptacle and configured to secure the male end of a standard USB cord when the fastening means is engaged.

2. The power adapter of claim 1, further comprising:

a second fastening tab extending from the second surface of the adapter body.

3. The power adapter of claim 2, wherein the cord-fastening means is configured to secure a cord attached to a male USB connector from a standard USB cord by preventing the male USB connector from being removed from the female USB receptacle when the fastening means is engaged.

* * * * *